US006023049A

United States Patent [19]

Huang

[11] Patent Number: 6,023,049

[45] Date of Patent: Feb. 8, 2000

[54] INSERTING STRUCTURE OF AN OIL COLLECTING PLATE FOR AN ELECTRIC OVEN

[76] Inventor: Sheng-I Huang, No. 35, Cheng-I, 12 Street, Jen-Te Shiang, Tainan Shien, Taiwan

[21] Appl. No.: 09/290,227

[22] Filed: Apr. 13, 1999

[51] Int. Cl.[7] ..... A47J 37/00; A47J 36/16; A47J 27/00

[52] U.S. Cl. ..... 219/392; 219/391; 99/400; 99/446

[58] Field of Search ..... 219/392, 391, 219/455.11; 99/400, 425, 444, 446

[56] References Cited

U.S. PATENT DOCUMENTS

| | | | |
|---|---|---|---|
| 2,868,111 | 1/1959 | Laskowski | 99/400 |
| 3,593,648 | 7/1971 | Walters | 99/400 |
| 3,669,002 | 6/1972 | Davidson | 99/400 |
| 3,685,434 | 8/1972 | Harrison | 99/425 |
| 3,938,431 | 2/1976 | Potvin | 99/425 |
| 4,647,758 | 3/1987 | Kelian | 99/400 |
| 5,823,099 | 10/1998 | Ko | 99/446 |

FOREIGN PATENT DOCUMENTS 3441767 5/1986 Germany .

*Primary Examiner*—Joseph Pelham
*Attorney, Agent, or Firm*—Rosenberg, Klein & Lee

[57] ABSTRACT

An inserting structure of an oil-collecting plate for an electric oven in the present invention is provided with a plate-inserting groove located below several electric heating tubes, along and inward the lower portion of three inner walls of the roasting room of an electric oven. The plate-inserting groove is properly provided for three sides of an oil-collecting plate to be inserted in so as to make the oil-collecting plate form an oil-collecting scope bigger than the dripping scope formed by the inner walls of the roasting room and take the most effect of collecting oil.

1 Claim, 4 Drawing Sheets

INSERTING STRUCTURE OF AN OIL COLLECTING PLATE FOR AN ELECTRIC OVEN

BACKGROUND OF THE INVENTION

1. Field of the Invention

The present invention relates to an inserting structure of an oil-collecting plate for an electric oven, and more particularly to an inserting structure of an oil-collecting plate which can substantially promote the oil-collecting effect of the oil-collecting plate of an electric oven.

2. Description of the Related Art

A conventional oil plate 12 is provided on the inner bottom surface of a roasting room 11 in an electric oven 1, as shown in FIG. 1. The circumference of the oil-collecting plate 12 and the inner walls of the roasting room 11 do not contact closely to each other so that the oil 13 dripping along the inner walls of the roasting room 11 can not drip in the oil-collecting plate 12 but drip on the inner bottom surface of the roasting room 11. Consequently, the drawback that the oil 13 can not be properly collected in the oil-collecting plate 12 makes the oil-collecting plate 12 take not so much effect and even results in the difficulty of clearing away the oil 13 dripping on the inner bottom surface of the roasting room 11.

SUMMARY OF THE INVENTION

Accordingly, the present invention is directed to an inserting structure of an oil-collecting plate for an electric oven which can substantially obviates the drawback of the above-mentioned related conventional art.

An object of the present invention is to provide an inserting structure of an oil-collecting plate for an electric oven which can make the oil-collecting scope of the oil-collecting plate bigger than the oil-dripping scope formed by the inner walls of the roasting room so that the oil dripping along the inner walls of the roasting room can be properly collected in the oil-collecting plate while food being roasted by the high temperature of the electric heating tubes in an electric oven.

Another object of the present invention is to provide an inserting structure of an oil-collecting plate for an electric oven which can make the oil-collecting plate take the most effect of collecting oil so as to prevent the oil from dripping on the inner bottom surface of the roasting room and to reduce the trouble of clearing the inner bottom surface of the roasting room.

Yet another object of the present invention is to provide an inserting structure of an oil-collecting plate for an electric oven which is simply composed and easily manufactured and can take the most effect.

To achieve these advantages, an inserting structure of an oil-collecting plate for an electric oven in the present invention is provided with a plate-inserting groove located below several electric heating tubes, along and inward the lower portion of three inner walls of the roasting room of an electric oven. The plate-inserting groove is properly provided for three sides of an oil-collecting plate to be inserted in so as to make the oil-collecting plate form an oil-collecting scope bigger than the dripping scope formed by the inner walls of the roasting room and take the most effect of collecting oil.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

Figure 1:
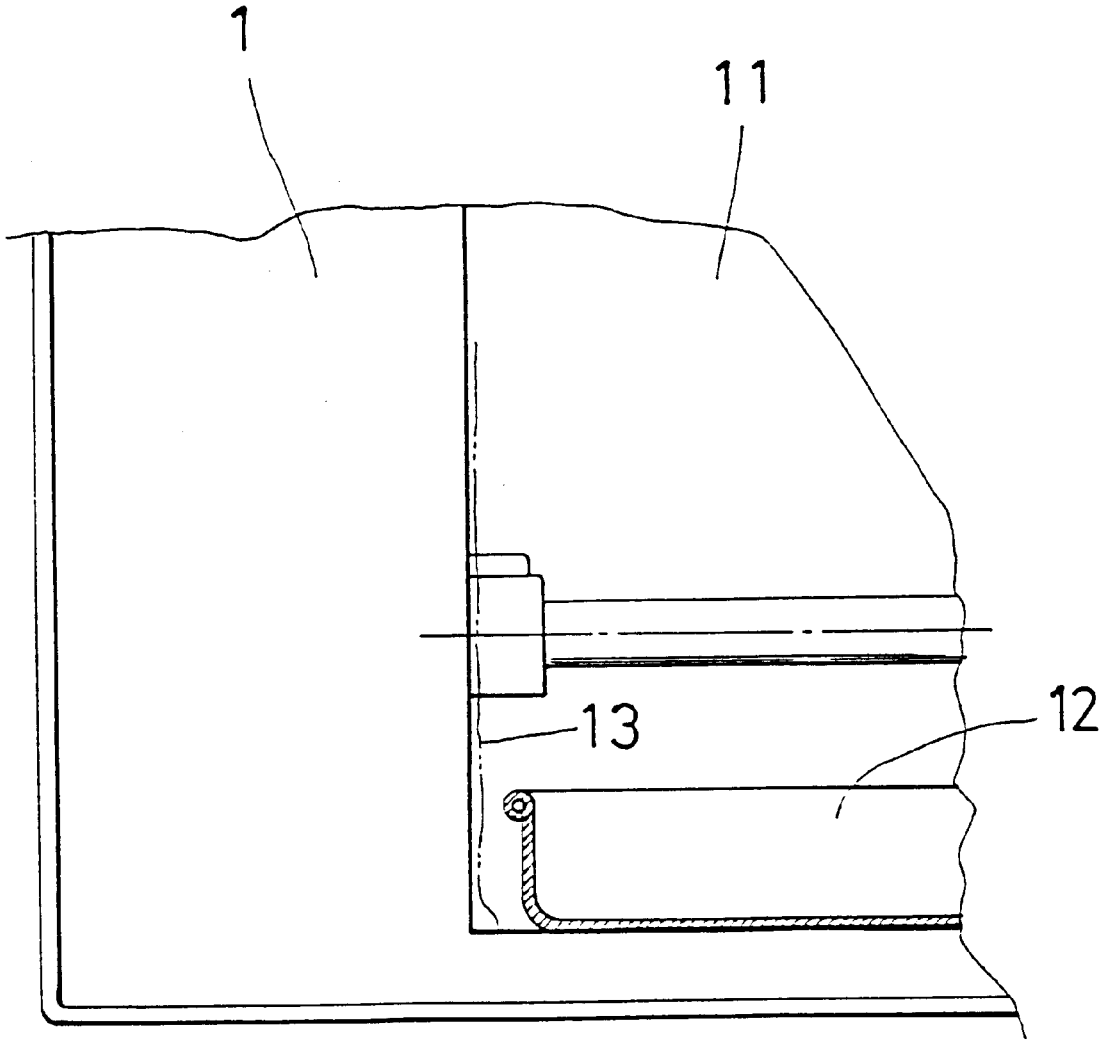
F I G. 1 (PRIOR ART)
FIG. 1 is a schematic view showing the position of an oil-collecting plate in the roasting room of a conventional electric oven.
Figure 2:
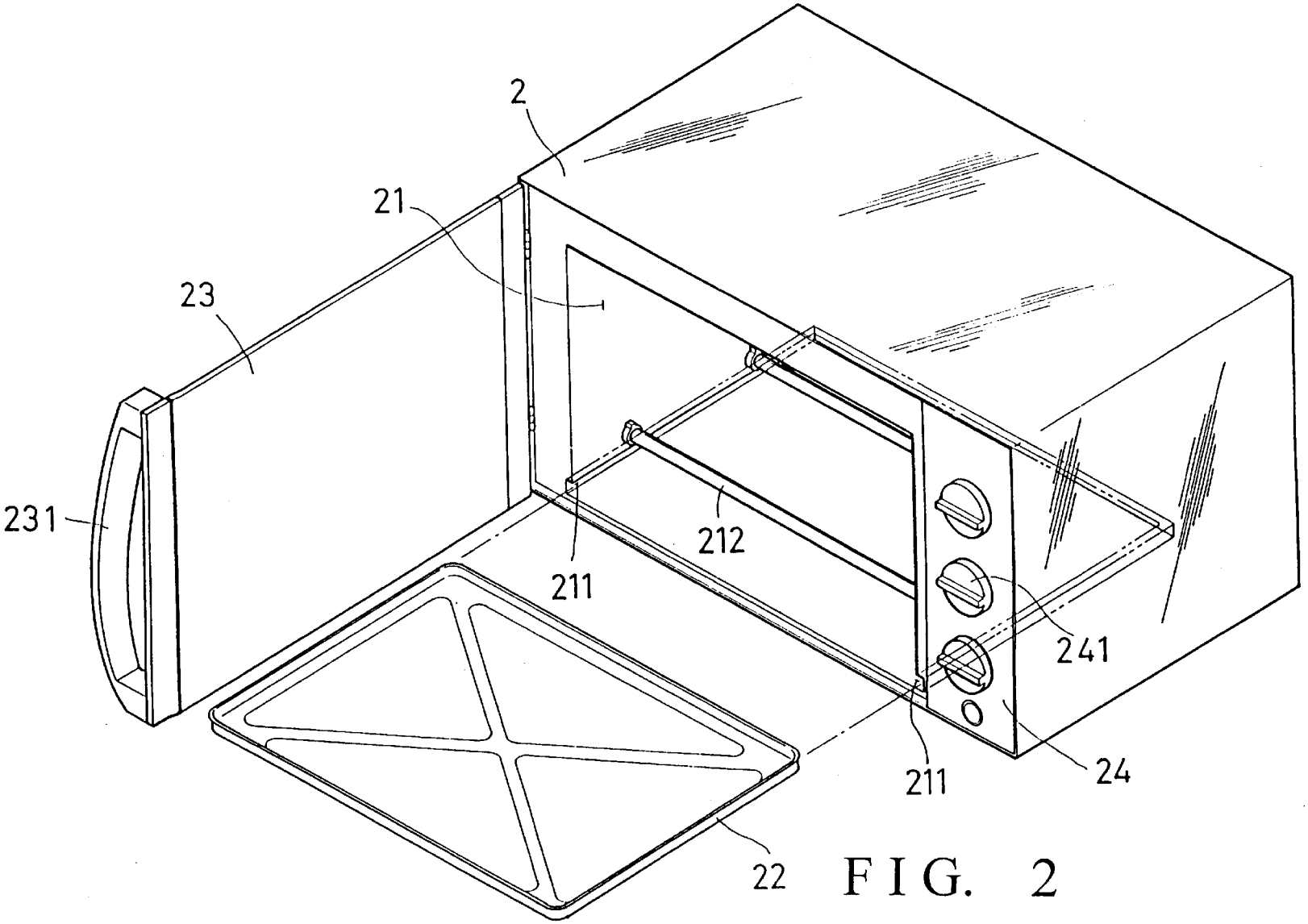
FIG. 2 is a perspective exploded view of an embodiment of the electric oven and the oil-collecting plate in accordance with the present invention.

Referring to FIG. 2, a preferred embodiment of an electric oven 2 in the present invention is provided with a roasting room 21 in the interior. A plate-inserting groove 211 is provided along and in the lower portion of three inner walls of the roasting room 21. The plate-inserting groove 211 is provided for three sides of an oil-collecting plate 22 to be inserted in.

Several electric heating tubes 212 are above the plate-inserting groove 211 and horizontally provided in the lower section of the roasting room 21 and so as to provide electric heat for roasting food. On the front left side of the electric oven 2 in the present invention is pivoted with a door 23 corresponding to the shape of the roasting room 21, and the door 23 is provided with a handle 231. An operation board 24 with a plurality of switches 241 is provided on the front right side of the electric oven 2.

Figure 3:
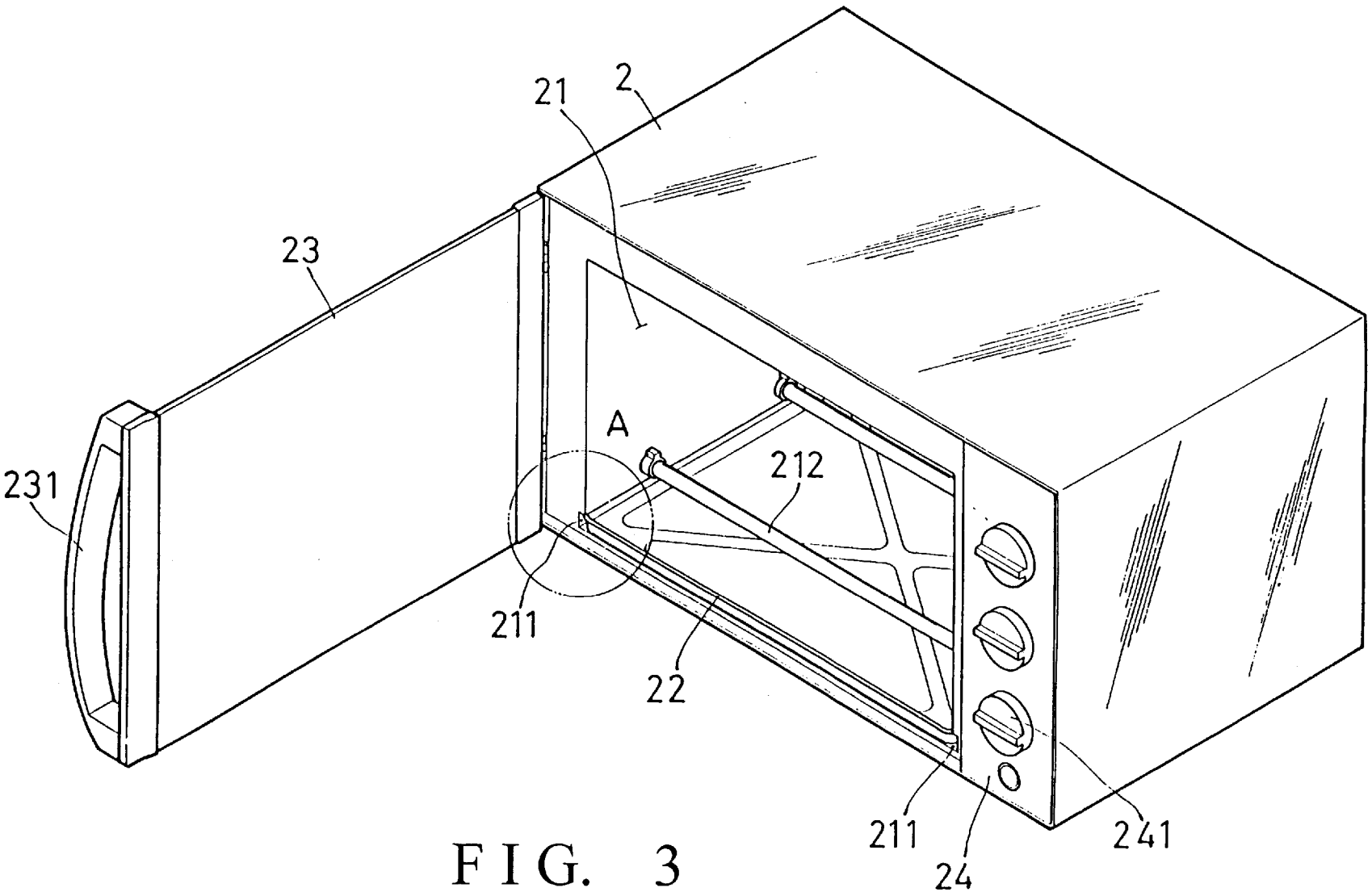
FIG. 3 is a perspective view showing the oil-collecting plate being inserted in the plate-inserting groove in the roasting room of the electric oven in accordance with an embodiment of the present invention; and, FIG. 4 is a partial enlarged view of the portion A in FIG. 3 showing the manner of the oil-collecting plate being inserted in the plate-inserting groove in the roasting room of the electric oven in accordance with an embodiment of the present invention.
Figure 4:
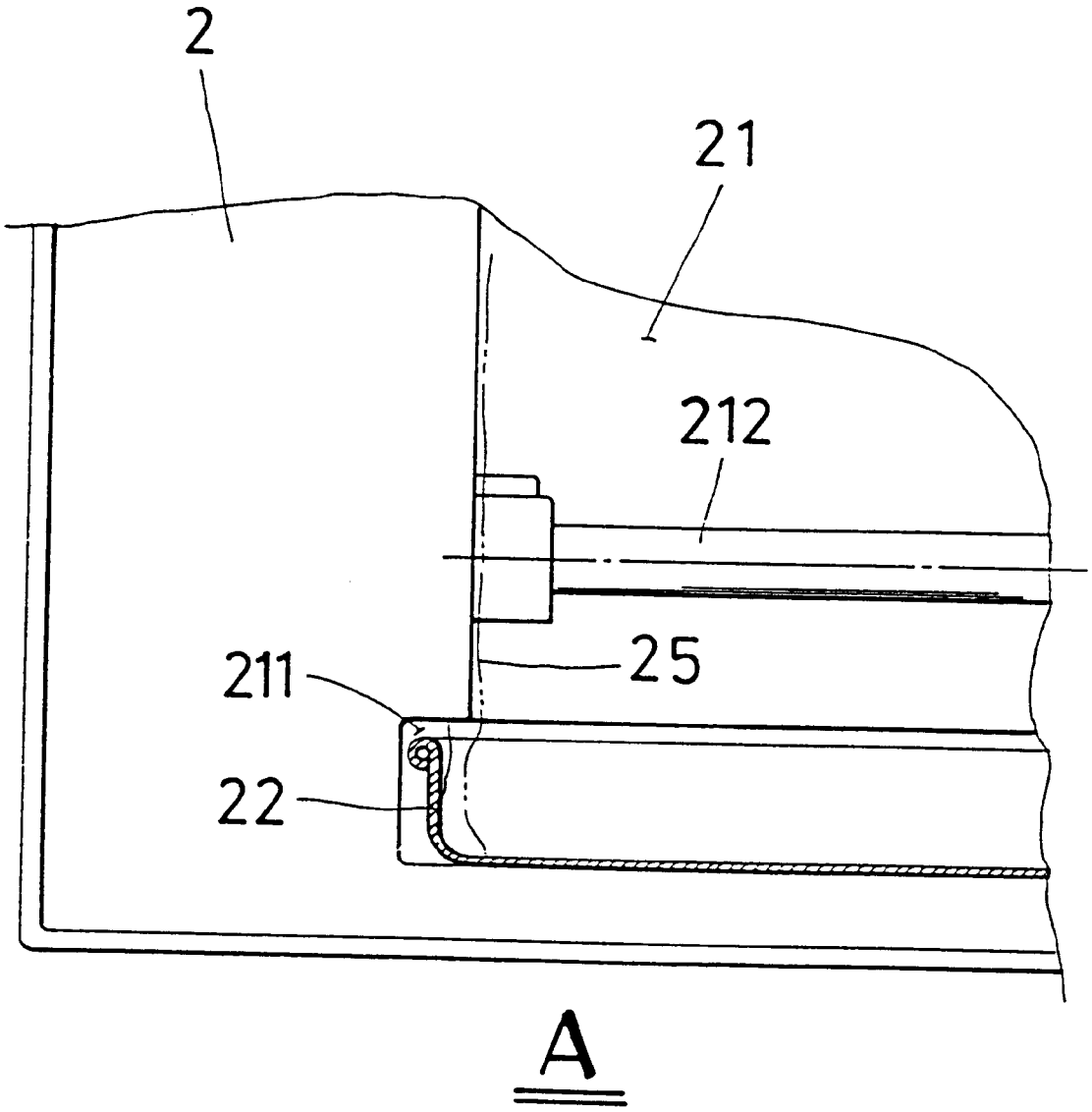

While being used, referring to FIGS. 3 and 4, three sides of the oil-collecting plate 22 are inserted into the plate-inserting groove 211 and closely against the inner wall of the plate-inserting groove 211 so as to form an oil-collecting scope bigger than the oil-dripping scope formed by the inner walls of the roasting room 21. Thus, the oil dripping along the inner walls of the roasting room 21 can be exactly collected in the oil-collecting plate 22.

While the preferred embodiments of the invention have been described above, it will be recognized and understood that various modifications may be made therein and the appended claims are intended to cover all such modifications which may fall within the spirit and scope of the invention.

What is claimed is:

1. An inserting structure of an oil-collecting plate for an electric oven comprising:

an electric oven being provided with a roasting room in the interior, several electric heating tubes being horizontally provided in the lower section of said roasting room so as to provide electric heat for roasting food, on the front left side of said electric oven being pivoted with a door corresponding to the shape of said roasting room, said door being provided with a handle, an operation board with a plurality of switches being provided on the front right side of said electric oven, the characteristic of said electric oven being that a plate-inserting groove provided along and in the lower portion of three inner walls of said roasting room and below said several electric heating tubes, said plate-inserting groove being provided for three sides of an oil-collecting plate to be inserted in, while being used, said three sides of said oil-collecting plate being inserted into said plate-inserting groove and closely against the inner wall of said plate-inserting groove so as to form an oil-collecting scope bigger than the oil-dripping scope formed by the inner walls of said roasting room, and thus, the oil dripping along the inner walls of said roasting room able to be exactly collected in said oil-collecting plate.

* * * * *